US005653533A

United States Patent [19]

Green

[11] Patent Number: 5,653,533

[45] Date of Patent: Aug. 5, 1997

[54] APPARATUS AND METHOD FOR INTRODUCING LIQUID ADDITIVES INTO A CONCRETE MIX

[75] Inventor: Thomas S. Green, Atwater, Ohio

[73] Assignee: ABC TechCorp., Akron, Ohio

[21] Appl. No.: 556,520

[22] Filed: Nov. 13, 1995

[51] Int. Cl.[6] ..... B28C 7/04; B01F 15/02; B67D 5/00

[52] U.S. Cl. ..... 366/19; 366/16; 366/3; 366/182.1; 366/182.2; 366/182.3; 366/182.4; 137/209; 137/453; 222/52

[58] Field of Search ..... 366/2, 3, 8, 16, 366/17, 19, 33, 34, 37, 40, 150.1, 182.1, 182.2, 182.3, 182.4; 137/209, 386, 433; 222/52, 55, 56, 57, 1; 141/9, 104, 105

[56] References Cited

U.S. PATENT DOCUMENTS

| | | | |
|---|---|---|---|
| 2,438,733 | 3/1948 | Yorke | 137/453 |
| 2,726,852 | 12/1955 | Sommer | 366/19 |
| 3,114,478 | 12/1963 | Hilkemeier et al. | 366/19 |
| 4,108,201 | 8/1978 | Lang | 137/453 |
| 5,102,228 | 4/1992 | Vine-Lott | 366/19 |
| 5,452,954 | 9/1995 | Handke et al. | 366/16 |
| 5,490,726 | 2/1996 | Davis et al. | 366/182.4 |

*Primary Examiner*—Tony G. Soohoo

*Attorney, Agent, or Firm*—Renner, Kenner, Greive, Bobak, Taylor and Weber

[57] ABSTRACT

A concrete mixing system includes reservoirs of liquid additives, where the additives are combined with concrete mix to add desired properties thereto. These reservoirs of liquid additive are connected to a storage chamber and a controller which controls and sequences various pumps, valves and sensors to attain the desired quantity of liquid additive for introduction to the concrete mix. The sensors measure pressure in the storage chamber, which the controller correlates to the volume therein for later mixing with the concrete mix. In situations where a back pressure in the chamber is a concern, a sensing tube is employed within the chamber. A differential pressure transducer, which has one sensor within the sensing tube and one sensor within the chamber, accurately determines the pressure and thus the volume received within the storage chamber. A modified sensing tube can also be employed to increase the sensitivity and the accuracy of the pressure measurement within the sensing tube.

17 Claims, 2 Drawing Sheets

APPARATUS AND METHOD FOR INTRODUCING LIQUID ADDITIVES INTO A CONCRETE MIX

TECHNICAL FIELD

The invention herein resides generally in the art of devices for introducing additives into concrete as the concrete is mixed. Specifically, the present invention relates to employing a sensing device which monitors a preselected characteristic within a storage chamber that holds a liquid additive to obtain the desired volume of additive for mixing with the concrete mix.

BACKGROUND ART

In constructing roads, buildings, bridges and the like, it is advantageous to use materials that are long lasting, easy to work with and cost effective. These materials include such things as timbers, brick, steel and concrete. Concrete is a preferred material because of its strength, permanency and relatively low cost when compared with other building materials. As is well known, concrete is made up of coarse and fine aggregate, such as gravel and sand, water and a cementing agent which is employed to bond the aggregate materials to one another. By varying the amount of the above ingredients, the concrete can be formulated with different properties. For example, by employing a reduced water to cement ratio, the strength of the concrete is maximized. These different concrete properties are employed depending upon the application and the stress expected to be received by the finished concrete.

It is also known to mix concrete with liquid additives to enhance particular properties of the concrete. For example, additives can be included with the mix of cement, aggregate and water to: lower the weight or density of the concrete; increase the thermal insulative qualities; add color; and add properties that are more resistant to particular natural conditions such as freezing and humidity. These additives include, but are not limited to, calcium chloride, liquid air (entraining), calcium substitutes, finishing agents, accelerants and retarders for drying, and plasticizers.

Previously, these additives were introduced with the concrete mix by manual methods. These methods employed a site tube within an intermediate vessel for receiving the liquid additive and then dumping the contents of the intermediate vessel into the concrete mix. There are also other types of mechanically operated dispensers to obtain the desired volume of additive.

Unfortunately, the aforementioned methods for mixing liquid additives with the concrete mix are inaccurate and detrimental to the manufacture of a superior concrete product. These manual methods of determining the proper volume of additive are also time consuming and unrepeatable where different types of concrete are required to be mixed in succession. The consequences of an improper volume of liquid additive can result in defective concrete thus requiring a large expense in and associated method for introducing liquid additives into a concrete mix. Furthermore, there is a need for an apparatus and associated method which ensures that the proper volume of liquid additive can be repeatably and reliably introduced to different batches of concrete mix.

DISCLOSURE OF INVENTION

In light of the foregoing, it is a first aspect of the present invention to provide an apparatus and associated method for introducing liquid additives into a concrete mix.

Another aspect of the present invention, as set forth above, is to provide a storage chamber connected to a reservoir of liquid additive, wherein the storage chamber is employed to collect the desired volume of liquid additive for later mixing with the concrete mix.

Still a further aspect of the present invention, as set forth above, is to provide sensing devices received within the storage chamber which monitor preselected characteristics such as pressure and/or temperature.

An additional aspect of the present invention, as set forth above, is to provide the required pumps, valves and pressure sources to regulate the inflow and outflow of the liquid additive from the storage chamber.

Yet an additional aspect of the present invention, as set forth above, is to provide a controller for monitoring the sensors, the pumps, the pressure source and the valves as required by the operator for providing the necessary mix of liquid additives, and other concrete ingredients.

A further aspect of the present invention, as set forth above, is to provide a sense tube which is received within the storage chamber and a differential pressure transducer attached to both and wherein the controller monitors the differential pressure transducer to measure pressure in the storage chamber and the sense tube to determine the volume of the liquid additive therein.

The foregoing and other aspects of the invention which shall become apparent as the detailed description proceeds, are achieved by an apparatus for introducing liquid additives into a concrete mix, comprising: a reservoir of liquid additive; a measurement chamber interconnected with the reservoir; a funnel adapted to receive the liquid additive from the measurement chamber and receive a supply of aggregate for mixing into concrete; first valve means connected to the measurement chamber for selectively venting the measurement chamber to atmosphere; first sensing means received within the measurement chamber for monitoring a pressure head therein; and control means interposed between the reservoir and the first sensing means for controlling dispensing of liquid additive from the reservoir to the measurement chamber as a function of the pressure head, the control means determining the correct mix of the supply of aggregate and the liquid additive to be received by the funnel.

The present invention also provides an apparatus for measuring liquid additives introduced into a concrete mix, comprising a plurality of reservoirs of liquid additives; a measurement chamber connected to each of the plurality of reservoirs; first valve means connected to each of the measurement chambers for selectively venting each of the measurement chambers to atmosphere; a sensing tube disposed within each measurement chamber, the sensing tube having a sealed top end opposite an open bottom end; a differential pressure transducer having a first sensor received within the sealed top end and a second sensor received within the measurement chamber and control means interposed between the plurality of reservoirs and the differential pressure transducer for controlling dispensing of liquid additive from each of the plurality of reservoirs to each of the measurement chambers as a function of the pressure head within each respective measurement chamber.

The present invention also provides a method for supplying additives to a concrete mixing system, comprising the steps of: supplying a predetermined amount of concrete mix to a mixing tank; providing at least one reservoir of liquid additive; providing a measurement chamber connected to each respective reservoir; receiving a sensing tube within each measurement chamber for monitoring a preselected characteristic, the sensing tube having a closed top end; controlling the amount of liquid additive transferred from the reservoir to the measurement chamber as a function of the preselected characteristic; and transferring the liquid additive from the measure chamber to the mixing tank for mixing with the concrete mix.

BEST MODE FOR CARRYING OUT THE INVENTION

Figure 1:
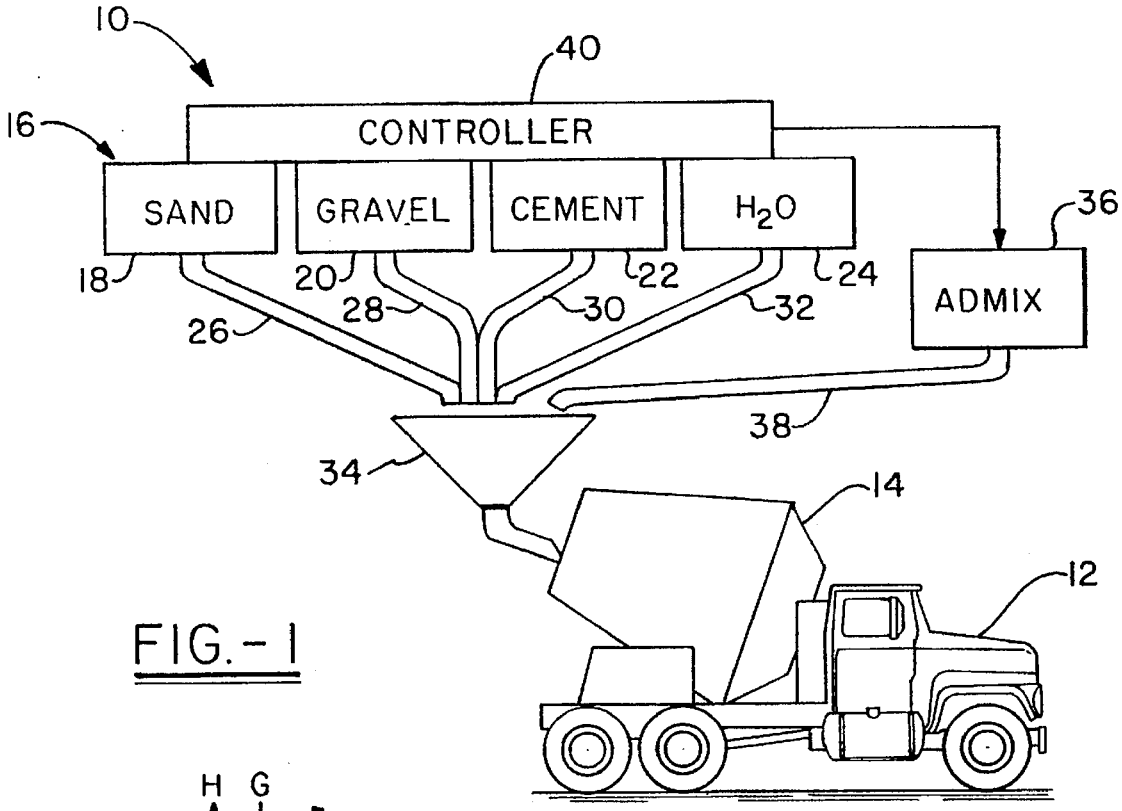
FIG. 1 is a schematic diagram of concrete mixing system.

Referring now to the drawings and more particularly to FIG. 1, it can be seen that a concrete mixing system according to the present invention is designated generally by the numeral 10. The concrete mixing system 10 includes a cement truck 12 with a mixing tank 14 which is adapted to rotate and mix the concrete aggregate and appropriate additives. While the mixing tank 14 is shown carried by a cement truck 12 it will be appreciated that the mixing tank 14 could be positioned independently at the construction site or in any desired manner. Included in the concrete mixing system 10 is an aggregate supply system 16 which provides the bulk storage components of the aggregate such as sand 18, gravel 20, cement 22 and a water supply 24, which is designated as $H_2O$ in FIG. 1. Each of these bulk storage materials 18–24 has a corresponding output nozzle and chute 26–32. Each of the output nozzles 26–32 are positioned above an in-feed trough or funnel 34 where the desired quantities of aggregate, cement and water are gathered to form the concrete mix.

An additive mix system 36 is also shown as a part of the concrete mixing system 10. It will be appreciated that the additive mix system 36 provides the necessary volume of liquid additives required for mixing with the concrete mix. These additives include, but are not limited to liquid air, calcium chloride, calcium substitutes, finishing agents, accelerators and retarders for drying purposes and plasticizers. As is well known in the art, these additives provide desired properties for the strength and finish appearance of the concrete and facilitate the handling and "finishing" of the concrete as it is poured. The additive mix system 36 has an output nozzle 38 which is positioned above the in-feed trough 34 for mixing with the bulk materials 18–24. A control system or controller 40 is interconnected to both the aggregate supply system 16 and the additive mix system 36. The control system 40 is essentially a microprocessor-based computer with a video monitor and a keyboard for providing the necessary input and output for an operator to operate the concrete mixing system 10. Included within the control system 40 is the necessary read only memory, look-up tables and other associated software for determining the correct mix of the aggregate supply system 16 and the additive mixing system 36 to obtain the desired finished concrete product.

Figure 2:
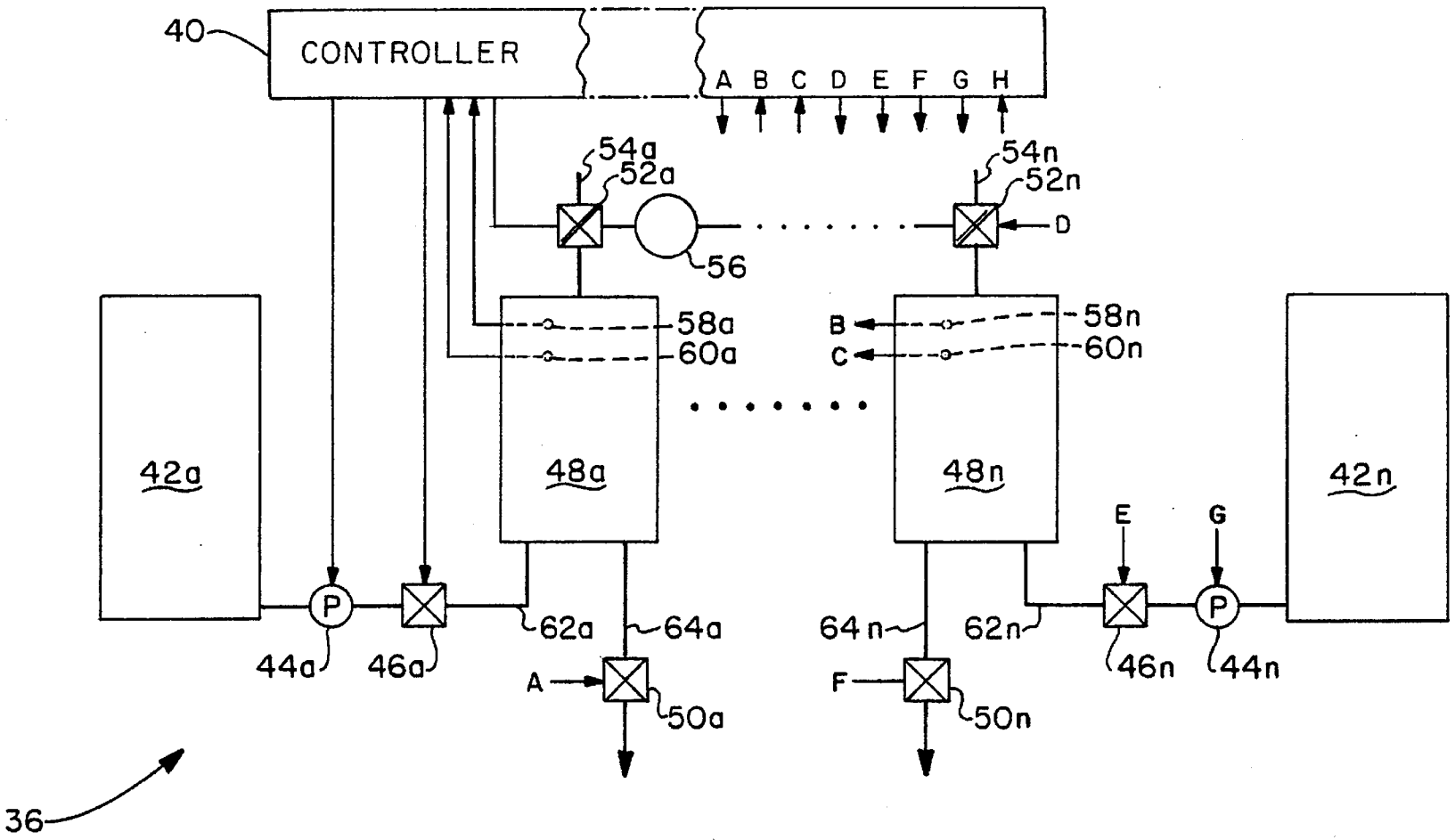
FIG. 2 is a schematic drawing of an additive mixing system.

Referring now to FIG. 2, it can be seen that the additive mixing system 36 is presented in a schematic diagram. In referring to FIG. 2, it will be appreciated that certain elements have alphabetic suffixes which designate that any number of those elements are contained within the additive mixing system 36. Each like alphabetic suffix (42*a*, 44*a*) refers to a particular unit within the additive mixing system 36. In particular, a plurality of liquid additive reservoirs 42*a–n* are shown. These reservoirs 42*a–n* are employed to store large quantities of the liquid additives. Connected to the outlet of each reservoir 42*a–n* is a pump 44*a–n* , wherein each pump 44*a*–n is connected to and controlled by the controller 40. Connected to the outlet of each pump 44*a–n* is a corresponding fill valve 46*a–n* which is also controlled by the controller 40. Each fill valve 46*a–n* is connected to a measurement and dispensing chamber 48*a*–n which receives the liquid additive from the associated reservoir 42*a*–n for later mixing with the concrete mix. A dispensing valve 50*a–n* is connected to the outlet of the chamber 48*a–n* for releasing the confirmed volume of liquid additive into the concrete mix. As seen in FIG. 2, the dispensing valves 50*a–n* have a control line identified as "A" which corresponds to the control line extending from the controller 40 also designated as "A". Where appropriate, other corresponding capital letter designations are employed in the drawings to designate a connection between the controller 40 and the associated element which is controlled or monitored thereby.

Extending from the chamber 48*a–n* is a corresponding three-way valve 52*a–n* which has two positions and three ports and is connected to and controlled by the controller 40. In its normal position, the three-way valve 52*a–n* is vented to atmosphere by a conduit 54*a–n* . In a second position, the three-way valve 52*a–n* is sealed. If required, a pressure source 56 having its own valve is connected to the three way valve 52 *a–n* when sealed. If the pressure head and gravity are insufficient to force the liquid additive out of chamber 48 *a–n* , the pressure source 56 generates a pressure head to flush out any liquid additive stored therein.

A pressure transducer 58*a–n* is received within the associated chamber 48*a–n* and is connected to and monitored by the controller 40. The pressure readings are employed by the controller to sequence the proper operation of the additive mixing system 36. Also received in the storage chamber 48*a–n* is a thermistor or temperature sensor 60*a–n* which provides a temperature reading to the controller 40 for use by the mixing system 36. It will be appreciated by those skilled in the art that other sensors could be carried on or about the chamber 48*a–n* for the purpose of monitoring preselected characteristics to ensure the proper operation of the mixing system 36.

An inlet conduit 62*a–n* provides the necessary path for transferring the additives from the reservoirs 42*a–n* to the associated storage chambers 48*a–n* . An outlet conduit 64*a–n* is connected to the storage chamber 48*a–n* for transferring the measured volume of liquid additive to the concrete mixing tank 14.

In operation, the controller 40 receives input, including but not limited to: the desired quantities of water 24, sand 18, gravel 20 and cement 22; system parameters such as material density of the various components of the aggregate supply system 16; sizes of the reservoir 42 and the chamber 48; and other parameters such as humidity, barometric pressure, and temperature. Of course, these determinations may be made manually and entered into the controller 40 by an operator via a keyboard. Based upon these inputs, the controller 40 determines the amount of liquid additive 48*a* that is to be supplied to the additive mixing system 36, whereupon the three-way valve 52*a* is moved from a vent position to a sealed position. The controller 40 instructs valve 46*a* to open for transferring the liquid additive from the reservoir 42*a* through the inlet conduit 62*a* to the chamber 48*a*. The controller 40 actuates the pump 44 to assist in transferring the liquid additive from the reservoir 42 to the chamber 48. The controller 40 monitors the pressure and temperature within the chamber 48 via the sensors 58*a* and 60*a* to determine the pressure head as the liquid additive is received therein. Those skilled in the art will appreciate that as liquid additive enters the sealed storage chamber 48*a*, the air contained therein is compressed, thereby increasing the pressure head. This pressure head information is received by the controller 40, which contains look-up tables, for correlation with the actual volume of Liquid additive or "column weight" received therein. Those skilled in the art will appreciate that the look-up tables correlate the pressure head within the chamber 48*a* to the volume of liquid additive received within the chamber 48*a*. When the controller 40 determines that the desired volume of Liquid additive has been attained, the controller closes valve 46*a* to stop the flow of liquid additive from the reservoir 42*a* to the chamber 48*a*. At this time, the controller 40 can confirm the volume of liquid additive contained within the chamber 48*a* and reopen the valve 46*a* if more liquid additive is desired. It will be appreciated that the temperature sensor 60 provides the controller 40 with data to temperature-compensate the pressure reading. Since a rapid inflow of additive into the chamber 48 may raise the temperature of the air comprising the pressure head—and thereby change the effective volume of the head for an associated pressure—it is necessary to compensate for temperature in the look-up tables to assure accurate volume determinations.

After the desired volume of liquid additive has been attained, the controller 40 closes the valve 46*a* and then opens valve 50*a* to release the liquid additive stored within the chamber 48*a* through the outlet conduit 64*a* to the output nozzle 38 for mixture within the mixing tank 14. Usually, the pressure head contained within the storage chamber 48 forces the liquid additive out the conduit 64*a* to the mixing tank 14. However, if required, the sealed valve 52*a* is connected to the pressure source 56 which then forces the liquid additive within the storage chamber 48*a* out of the conduit 64*a*. It will be appreciated that the embodiment just described is primarily designed for storage chambers which are of metal construction and which can withstand the high pressures subjected thereto when the three-way valve 52*a* is sealed.

Based upon the foregoing structure and methodology of determining and dispensing a volume of liquid additive for mixing with concrete, it will be appreciated that a plurality of reservoirs of different liquid additives could be connected to a single storage chamber wherein the single storage chamber transfers the liquid additive to the mixing tank 14. It will also be appreciated that this variation would provide a flushing mechanism within the storage chamber after each use so that the liquid additives are not intermixed.

Figure 3:
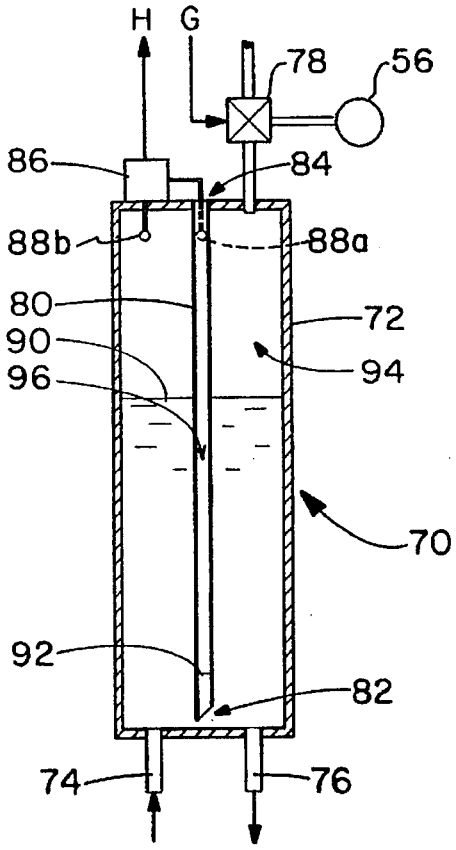
FIG. 3 is a schematic drawing of a storage chamber with a sensing tube received therein.

In another variation of the concrete additive mixing system, as shown in FIGS. 2 and 3, a measurement and dispensing chamber system, designated generally by the numeral 70, is provided. Where appropriate, elements that are common with the previous embodiment are employed in the present embodiment. The chamber system 70 includes a chamber 72 which is usually constructed of a glass or plastic material. The chamber 72 has an inlet 74, an outlet 76, and a three-way valve 78 which is connected at the top of the chamber 72. The three-way valve 78 can be positioned to vent the chamber 70 or to seal the chamber 70 with a pressure source 56 connected thereto. The three-way valve 78 is connected to and monitored by the controller 40.

A sensing tube 80 is received within the chamber 72, wherein the sensing tube has an open bottom end 82 by virtue of a bias cut in close proximity to the bottom of the chamber 72. The sensing tube 80 also has a sealed top end 84 at the top of the chamber 72. The sealed top end 84 is either dosed by the top of chamber 72 or is dosed separately. A differential pressure transducer 86, which is connected to and monitored by the controller 40, has two pressure sensors 88. One sensor 88*a* is received within the top end 84 and the other sensor 88*b* is received in the top of chamber 72. With three-way valve 78 in a vent position as liquid additive enters the inlet 74, a liquid level 90 rises in chamber 72 and a liquid level 92 rises in sensing tube 80. Accordingly, a head space 94 is defined between the liquid level 90 and the top of the chamber 70. Likewise, a head space 96 is defined between the liquid level 92 and the top of sealed sensing tube 80. The differential pressure transducer 86, subtracts the pressure value read by the sensor 88*a* (the sensing tube headspace 96) from the pressure value read by the sensor 88*b* (the chamber headspace 94) to determine a pressure reading that is sent to the controller 40 for correlation to a volume of liquid additive received in the chamber 72.

In this embodiment, the measurement dispensing and chamber system 70 is made of glass or plastic and if sealed, cannot withstand the abnormally high back pressure caused by the rapid inflow of liquid additive. Also, as is well known, high back pressure causes distortions in the pressure readings in a sealed chamber. Therefore, the sensing tube 80 is employed to obtain a pressure reading indicative of the volume of liquid additive in the chamber 72 while any excessive pressure is vented to atmosphere. The pressure head within the chamber 72 adds to the pressure head within the sealed sensing tube 80 and must be compensated for, as discussed below, to obtain an accurate pressure reading. Although a temperature sensor could be employed in this embodiment, any increase in temperature in the chamber 72 is considered inconsequential to the pressure readings. If employed, a temperature sensor would be attached to the sensing tube 80 and connected to the controller 40 so that the appropriate adjustments to the pressure reading and thus the volume could be made.

In particular, the three-way valve 78 vents any excess pressure within the chamber 72 to atmosphere. The controller 40 opens valve 46 to allow for the inflow of liquid additive through conduit 74 into the chamber 72. As before, a pump 44 is employed to assist in the transfer of liquid additive from the reservoir 42 to fill the chamber 72 and the sealed sensing tube 80. Those skilled in the art will appreciate that the pressure reading within the sealed sensing tube 80 is substantially greater than the pressure sensed within the vented chamber 72. Generally, the chamber 72 is at atmospheric pressure through the venting by valve 78. However, if the pump 44 causes an inflow of material into the chamber 72 faster than can be vented by the valve 78, a slight pressure head develops in the chamber 72. The pressure transducer 86 sends the difference of these pressures in the sensing tube 80 and the chamber 72 to the controller 40, which doses valve 46 when the correct volume is attained. As before, the controller 40, with its appropriate look-up tables, converts the pressure reading into a volume reading while compensating for other system anomalies and parameters of the measurement and dispensing chamber system 70. It will be appreciated that the volume reading includes the liquid additive in the sensing tube 80 and the chamber 72.

If desired, the controller 40 doses valve 46 and connects the chamber 72 to pressure source 56 and confirms the volume received therein. If the controller 40 determines that the desired volume has not been attained, valve 46 can be reopened and the valve 78 vented to atmosphere until the correct volume is received. Once the desired volume has been attained, the controller 40 closes valve 46 and connects valve 78 to pressure source 56 and opens valve 50 to dispense the liquid additive through conduit 76 into the mixing tank 14. Once the dispensing operation is complete, the controller 40 closes valve 50 and repeats the process as required.

Figure 4:
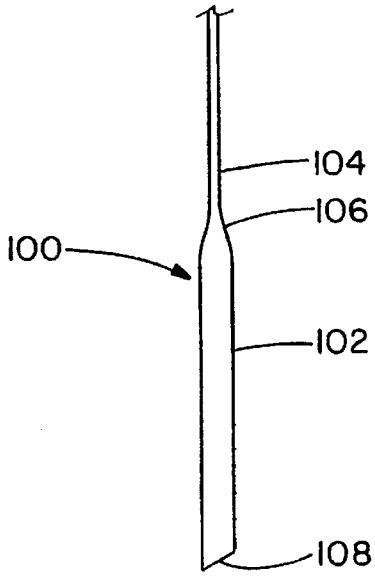
FIG. 4 is an elevational view of a sensing tube.

Referring now to FIG. 4, a sensing tube generally indicated by the numeral 100, is shown. The sensing tube 100 has an enlarged bottom 102 from which upwardly extends a small diameter top 104. Between the enlarged bottom 102 and the small diameter top 104 is a transitional necked-down area 106. The enlarged bottom 102 has a biased cut 108. Those skilled in the art appreciate that the enlarged bottom 102 is a relatively small portion of the entire length of the sensing tube 100.

In operation, the top 104 provides a smaller volume, thereby increasing the pressure head as liquid additive enters the biased cut 108. In other words, a small increase of additive in the bottom 102 generates a relatively large increase of the pressure reading in the top 104. This allows for a storage chamber to receive small quantities of liquid additive while providing an accurate pressure measurement while minimizing the amount of additional liquid forced into sensing tube 100 by any pressure head in the space 96, which additional liquid is subsequently dispensed—adding marginally to the desired quantity.

Although the differential pressure transducer 86 provides an accurate reading, it will be appreciated that a more precise reading could be obtained by employing the sensors 88*a* an 88*b* to read absolute pressure rather than the differential. The transducer 86 can be employed as a sending unit to transfer the absolute pressure readings from the sensors 88*a* and 88*b* to the controller 40. Accordingly, the absolute pressure readings in both the sensing tube 80 and the chamber 70 could be employed to determine the total volume therein.

The liquid additive and related pressure head in the sensing tube 80 is monitored by the controller 40 to determine a sensing tube volume that directly correlates to the volume in the chamber 72. Since the pressure readings are monitored "on-the-fly," or as the liquid additive enters the chamber 72, any increase in absolute pressure in the chamber 72 contributes to an increase in the absolute pressure in sensing tube 80. As such, the controller 40 monitors both absolute pressure values to determine the total volume of liquid additive.

Based upon the foregoing structure and operation of the apparatus for mixing liquid additives within a concrete mix it should be apparent that numerous advantages are realized. Primarily, the embodiments of the present invention provide an accurate and consistent reading of volume of liquid additives to be mixed within the concrete mix for a particular application. This allows an operator to provide the correct type of concrete for a structure. The present invention also provides the advantage of using multiple additives in conjunction with a concrete mixing system, wherein the correct and proper mount of additive is easily obtained. Finally, the present invention provides an advantage in that the controller is programmable to accomodate various system anomalies.

Thus it can be seen that the objects of the invention have been attained by the structure and methodology presented above. While in accordance with the patent statutes, only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. Apparatus for introducing liquid additives into a concrete mix, comprising:

a reservoir of liquid additive;

a measurement chamber interconnected with said reservoir;

a funnel adapted to receive the liquid additive from said measurement chamber and receive a supply of aggregate for mixing into concrete;

first valve means connected to said measurement chamber for selectively venting said measurement chamber to atmosphere;

first sensing means received within said measurement chamber for monitoring a pressure head therein; and control means interposed between said reservoir and said first sensing means for controlling dispensing of liquid additive from said reservoir to said measurement chamber as a function of the pressure head, said control means determining the correct mix of said supply of aggregate and the liquid additive to be received by said funnel.

2. The apparatus according to claim 1, further comprising:

a sensing tube disposed within said measurement chamber, said sensing tube having a sealed top end opposite an open bottom end; and a differential pressure transducer having a first sensor received within said sealed top end and a second sensor received within said measurement chamber, said differential pressure transducer connected to said controller for controlling dispensing of liquid additive from said reservoir to said measurement chamber as a function of said pressure head within said sensing tube.

3. The apparatus according to claim 2, where said first sensing means comprises a pressure transducer.

4. The apparatus according to claim 3, further comprising a pump interposed between said reservoir and said measurement chamber, said control means controlling said pump to transfer the liquid additive from said reservoir to said measurement chamber.

5. The apparatus according to claim 4, further comprising a pressure source interconnected to said measurement chamber through said first valve means.

6. The apparatus according to claim 5, wherein said open bottom end has a bias cut.

7. The apparatus according to claim 5, wherein said sensing tube as an enlarged bottom extending from a small diameter top to increase the sensitivity of said sensing tube.

8. Apparatus for measuring liquid additives introduced into a concrete mix, comprising:

a plurality of reservoirs of liquid additive;

a measurement chamber connected to each of said plurality of reservoirs;

first valve means connected to each of said measurement chambers for selectively venting each of said measurement chambers to atmosphere;

a sensing tube disposed within each said measurement chamber, said sensing tube having a sealed top end opposite an open bottom end;

a differential pressure transducer having a first sensor received within said sealed top end and a second sensor received within said measurement chamber; and control means interposed between said plurality of reservoirs and said differential pressure transducer for controlling dispensing of liquid additive from each of said plurality of reservoirs to each of said measurement chambers as a function of the pressure head within each respective said measurement chamber.

9. The apparatus according to claim 8, further comprising:

a pump interposed between each said plurality of reservoirs and each respective said measurement chamber; and a second valve means interposed between each said pump and each respective said measurement chamber, said control means controlling said pump and said second valve means to transfer the liquid additive from each said reservoir to each respective said measurement chamber.

10. The apparatus according to claim 9, further comprising a pressure source interconnected to said plurality of measurement chambers through each respective said first valve means.

11. The apparatus according to claim 10, further comprising:

third valve means interconnected to each said measurement chamber, said control means controlling the opening and closing of said third valve means to pass the liquid additive from said measurement chamber to a tank for mixing with concrete.

12. The apparatus according to claim 10, wherein said differential pressure transducer is connected to said controller for controlling dispensing of liquid additive from said reservoir to said measurement chamber as a function of said pressure head within said sensing tube.

13. The apparatus according to claim 12, wherein said sensing tube has an enlarged bottom extending from a small diameter top to increase the sensitivity of said sensing tube.

14. A method for supplying additives to a concrete mixing system, comprising the steps of:

supplying a predetermined amount of concrete mix to a mixing tank;

providing at least one reservoir of liquid additive;

providing a measurement chamber connected to each respective said reservoir;

receiving a sensing tube within each said measurement chamber for monitoring a preselected characteristic, said sensing tube having a closed top end;

controlling the amount of liquid additive transferred from said reservoir to said measurement chamber as a function of said preselected characteristic; and transferring the liquid additive from said measurement chamber to the mixing tank for mixing with the concrete mix.

15. The method according to claim 14, further comprising the steps of:

providing a first sensor at said closed top end and a second sensor received within said measurement chamber; and comparing readings between said first sensor and said second sensor to determine a value for said preselected characteristic.

16. The method according to claim 15, further comprising the steps of:

providing a pump interposed between said reservoir and each respective said measurement chamber; and controlling said pump to transfer the liquid additive from said reservoir to each respective said measurement chamber.

17. The method according to claim 16, further comprising the step of monitoring the pressure head within said measurement chamber.

* * * * *